US010427059B1

(12) United States Patent
Goddard et al.

(10) Patent No.: US 10,427,059 B1
(45) Date of Patent: Oct. 1, 2019

(54) RIDE SYSTEM: MOTION BASE ON A TURNTABLE/SEGMENTED TURNTABLE

(71) Applicant: DISNEY ENTERPRISES, INC., Burbank, CA (US)

(72) Inventors: Steven L. Goddard, Burbank, CA (US); John Larena, Burbank, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 0 days.

(21) Appl. No.: 16/147,387

(22) Filed: Sep. 28, 2018

(51) Int. Cl.
*A63G 31/16* (2006.01)
*A47C 1/12* (2006.01)
*A63G 31/02* (2006.01)
*A63G 1/10* (2006.01)

(52) U.S. Cl.
CPC ..... *A63G 31/16* (2013.01); *A47C 1/12* (2013.01); *A63G 1/10* (2013.01); *A63G 31/02* (2013.01)

(58) Field of Classification Search
CPC .. A47C 1/12; A63B 1/10; A63B 31/16; A63G 31/02
USPC ..... 472/29
See application file for complete search history.

(56) References Cited

U.S. PATENT DOCUMENTS 3,724,842 A * 4/1973 Wisdom ..... A63G 1/34 472/3
5,115,744 A * 5/1992 Barber ..... A63G 7/00 104/300
6,042,382 A * 3/2000 Halfhill ..... A63G 1/26 434/55
6,113,500 A * 9/2000 Francis ..... A63G 31/16 472/130
6,220,171 B1 * 4/2001 Hettema ..... A63G 7/00 104/53
6,796,908 B2 * 9/2004 Weston ..... A63G 7/00 434/55
7,484,460 B2 * 2/2009 Blum ..... A63G 7/00 104/53
2005/0014566 A1 * 1/2005 Hashimoto ..... A63G 31/16 472/59
2010/0326312 A1 * 12/2010 Jacobi ..... A63G 7/00 104/75
2013/0059670 A1 * 3/2013 Crawford ..... A63G 1/00 472/36
2016/0236099 A1 * 8/2016 Follmer ..... G03B 21/562

* cited by examiner

*Primary Examiner* — Michael D Dennis
(74) *Attorney, Agent, or Firm* — Kilpatrick Townsend & Stockton LLP

(57) ABSTRACT

Embodiment of turntables, which can include rotating indexed turntables are described herein. The rotating indexed turntable can include: a looped track having an inner rail and an outer rail; a plurality of adjacent turntable wagons linked together in a closed chain and movingly coupled to the looped track, wherein each of the turntable wagons are independently propelled along the looped track, each of the plurality of turntable wagons including: an inner portion having a first length; an outer portion having a second length, which second length is greater than the first length; a plurality of outer motion features movingly coupled to the outer rail of the looped track; and at least one inner motion feature movingly coupled to the inner rail of the looped track.

11 Claims, 6 Drawing Sheets

RIDE SYSTEM: MOTION BASE ON A TURNTABLE/SEGMENTED TURNTABLE

BACKGROUND

The present disclosure relates generally to creation of a simulated experience. A simulation is the imitation of a real-world process or event over time, or the imitation of an imaginary process or event over time. Simulations can include, for example, a simulation of operation of a vehicle such as a car, an airplane, a boat, or a spaceship.

While the simulation theaters can provide a high quality user experience, simulation theaters present problems. Specifically, simulation theaters are not easily adapted to passenger throughput and specifically to high passenger throughput. These problems are becoming more common as simulation theaters are increasingly used in different environments. Accordingly, systems and devices for creating a simulation experience are desired.

BRIEF SUMMARY

Embodiments disclosed herein can provide systems and/or devices including simulation theaters. These systems and/or devices can include a plurality of wagons linked in a closed change that can transit around a closed track. Each of the wagons can include a plurality of wheels, at least two of which can be driven. In some embodiments, each wagons can have three wheels and/or at least three wheels to create a statically determinate wagon. In such embodiments, and because the wagon is statically determinate, the load on each of the at least three wheels can be determined and the design of the wagon can be optimized to allow handling of these determined loadings.

The systems and/or devices can include a plurality of simulation theaters, each of which simulation theaters can be coupled with one of the plurality of wagons. In some embodiments, these simulation theaters can include a screen coupled and/or connected to the wagon, a projector that is likewise coupled to the wagon, and a seating area comprising a plurality of seats. The screen can, in some embodiments, extend at least partially around the seating area. In some embodiments, the seating area can be coupled to the wagon via a motion base that can move the seating area to simulate motions, accelerations, or the like.

One aspect of the present disclosure relates to a rotating indexed turntable. The rotating indexed turntable includes a looped track having an inner rail and an outer rail; a plurality of adjacent turntable wagons linked together in a closed chain and movingly coupled to the looped track. In some embodiments each of the turntable wagons are independently propelled along the looped track, and each of the plurality of turntable wagons includes: an inner portion having a first length; an outer portion having a second length, which second length is greater than the first length; a plurality of outer motion features movingly coupled to the outer rail of the looped track; and at least one inner motion feature movingly coupled to the inner rail of the looped track.

In some embodiments, the looped track can be a circular track. In some embodiments, the plurality of outer motion features can include a plurality of outer wheels. In some embodiments, the plurality of outer motion features can include a pair of outer wheels. In some embodiments the inner motion feature can include a single wheel.

In some embodiments, the plurality of turntable wagons further include a plurality of motors connected to the plurality of outer wheels. In some embodiments, each of the plurality of outer wheels is independently driven. In some embodiments, each of the plurality of turntable wagons is connected to each of two other turntable wagons via a towbar. In some embodiments, the towbar has a constant length.

In some embodiments, the rotating indexed turntable includes: at least one simulation theater; a screen; and a projector. In some embodiments, each of the simulation theater, the screen, and the projector are coupled to at least one of the plurality of turntable wagons. In some embodiments, the at least one simulation theater is coupled to the at least one of the plurality of turntable wagons via a motion base. In some embodiments, the motion base can be a Stewart platform having eight actuators.

One aspect of the present disclosure relates to a simulation system. The simulation system includes: a closed track; and a plurality of wagons linked in an enclosed chain and extending around the closed track. In some embodiments, each of the plurality of wagons can include a first motion component, a second motion component, and a third motion component. In some embodiments, each of the plurality of wagons moves along the closed track in a first direction via the first, second, and third motion components. In some embodiments, each of the plurality of wagons includes: a platform; a seating area having a plurality of seats; a screen coupled to the platform and extending at least partially around the seating area; and at least one projector that can illuminate at least a portion of the screen.

In some embodiments the first, second, and third motion components each can be a wheel. In some embodiments, at least two of the first, second, and third motion components are driven. In some embodiments, the seating area has a first orientation pointing the plurality of seats in a second direction, and in some embodiments, the second direction is orthogonal to the first direction. In some embodiments, each of the plurality of wagons is connected to each of two other wagons via a towbar. In some embodiments, the towbar has a constant length.

In some embodiments, the seating area is coupled to the platform via a motion base. In some embodiments, the motion base has at least 6 degrees of freedom. In some embodiments, the motion base can be a Stewart platform. In some embodiments, the platform of each of the plurality of wagons can include: an inner portion having a first length; and an outer portion having a second length. In some embodiments, the second length is greater than the first length. In some embodiments, the first and second motion portions are located proximate to the outer portion.

DETAILED DESCRIPTION

The ensuing description provides illustrative embodiment(s) only and is not intended to limit the scope, applicability or configuration of the disclosure. Rather, the ensuing description of the illustrative embodiment(s) will provide those skilled in the art with an enabling description for implementing a preferred exemplary embodiment. It is understood that various changes can be made in the function and arrangement of elements without departing from the spirit and scope as set forth in the appended claims.

I. Introduction

With the development of technology, traditional amusement rides are increasingly blending with simulations. In spite of this blending, significant challenges remain in such hybrid experiences. While the simulators can provide a high quality user experience, simulators are not well adapted to the high passenger throughput common to amusements rides. These challenges of high throughput are particularly apparent in the loading and unloading of simulation theaters. The present disclosure relates to systems and devices that improve simulation experiences and that address problems relating to passenger throughput.

II. Simulation System

Figure 1:
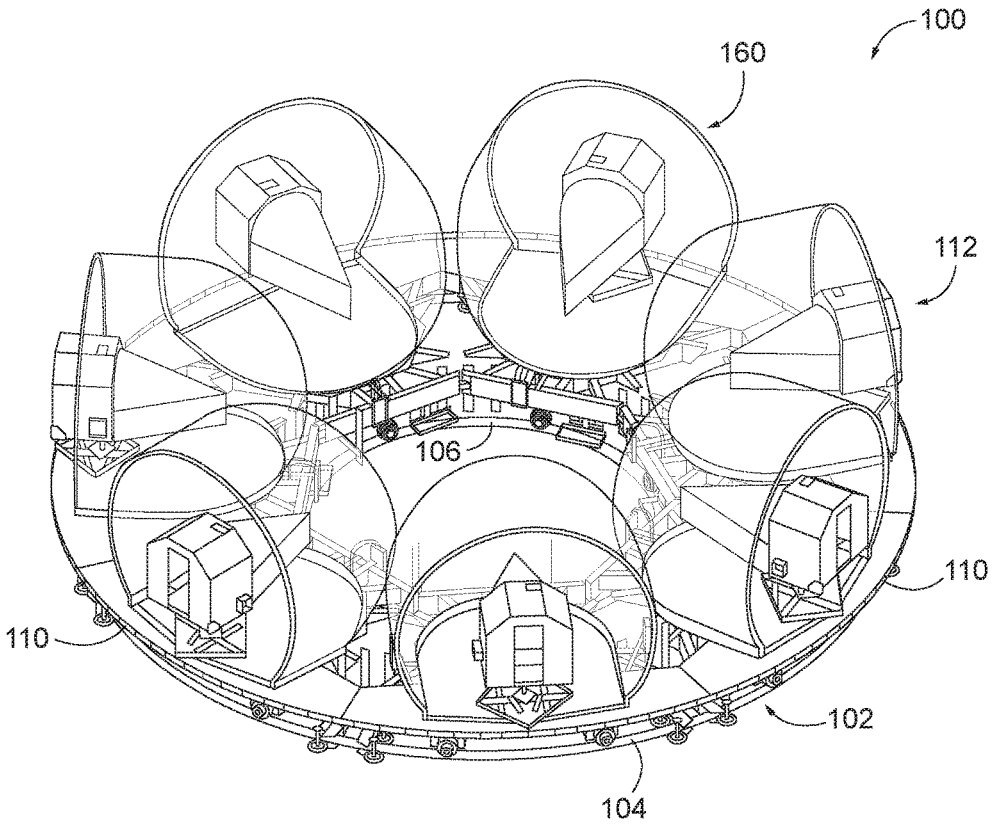
FIG. 1 is a perspective view of one embodiment of a simulation system/

With reference now to FIG. 1, a perspective view of one embodiment of a simulation system 100 is shown. The simulation system 100 can include a track 102 that can be a closed track, upon which a plurality of wagons 110 forming a segmented turntable 112. As used herein, a closed track refers to a track forming a loop, such as, a circular loop, an oval loop, an elliptical loop, an irregularly shaped loop such as the Grand Prix race track or the North loop at the Nürburgring, and/or a loop of any other desired shape or size. Thus, in some embodiments, the track 102 can comprise a circular track. The track 102 can include an outer rail 104 and an inner rail 106. The track 102 can be made of any material having strength sufficient to support the remaining portions of the simulation system 100 and can include, for example, a concrete, a metal such as a steel, iron, an iron alloy, aluminum, an aluminum alloy, a composite, a polymer, or the like.

III. Segmented Turntable

Figure 2:
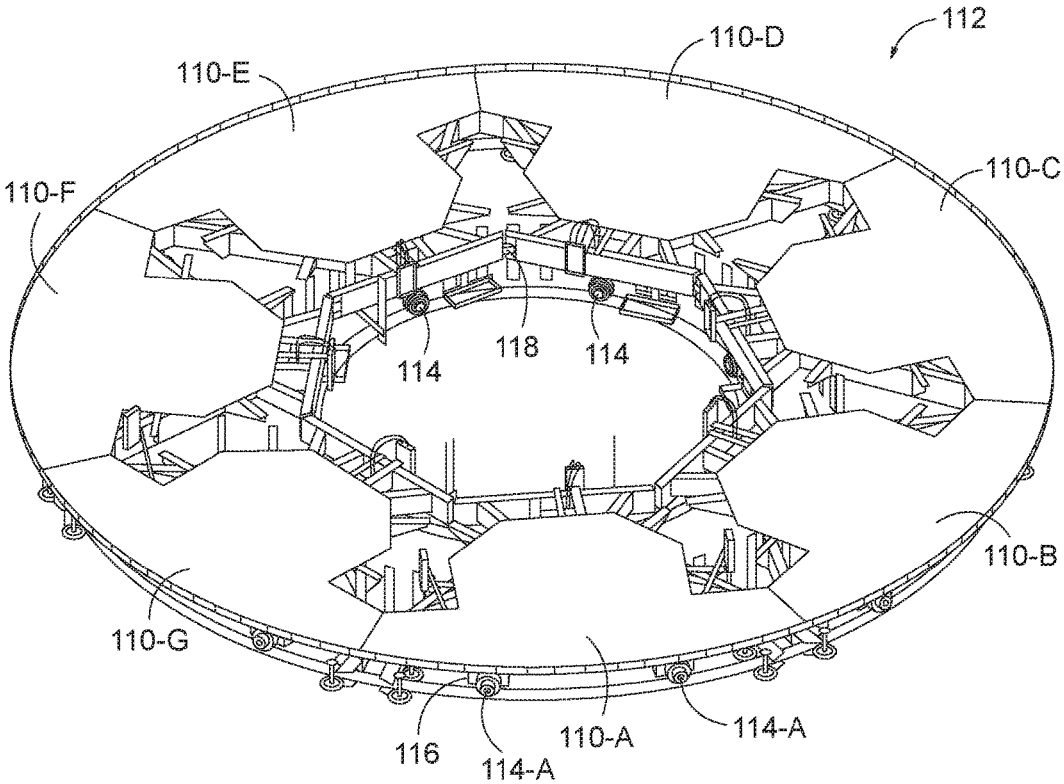
FIG. 2 is a perspective view of one embodiment of the segmented turntable.

With reference now to FIG. 2, a perspective view of one embodiment of the segmented turntable 112 comprises the plurality of wagons 110 is shown. The plurality of wagons 110 can include any desired number of wagons including, for example, 2 wagons, 3 wagons, 4 wagons, 5 wagons, 6 wagons, 7 wagons, 8 wagons, 9 wagons, 10 wagons, 15 wagons, 20 wagons, 25 wagons, 30 wagons, 40 wagons, 50 wagons, 75 wagons, 100 wagons, and/or any other or intermediate number of wagons. In the embodiment of FIG. 2, the plurality of wagons 110 includes a first wagon 110-A, a second wagon 110-B, a third wagon 110-C, a fourth wagon 110-D, a fifth wagon 110-E, a sixth wagon 110-F, and a seventh wagon 110-G. The plurality of wagons 110 can be linked together in a continuous chain and/or in an enclosed chain that extends, in some embodiments, completely around the track. As used herein the plurality of wagons form an enclosed chain and/or form a continuous chain when there is not beginning or end to the chain. Thus, as shown, each of the plurality of wagons 110 can be connected to a one of the plurality of wagons 110 immediately preceding that each of the plurality of wagons 110 and can be connected to a one of the plurality of wagons 110 immediately following that each of the plurality of wagons 110. By way of example, in some embodiments, the third wagon 110-C can be connected to the second wagon 110-B and the third wagon 110-C can be connected to the fourth wagon 110-D.

Figure 3:
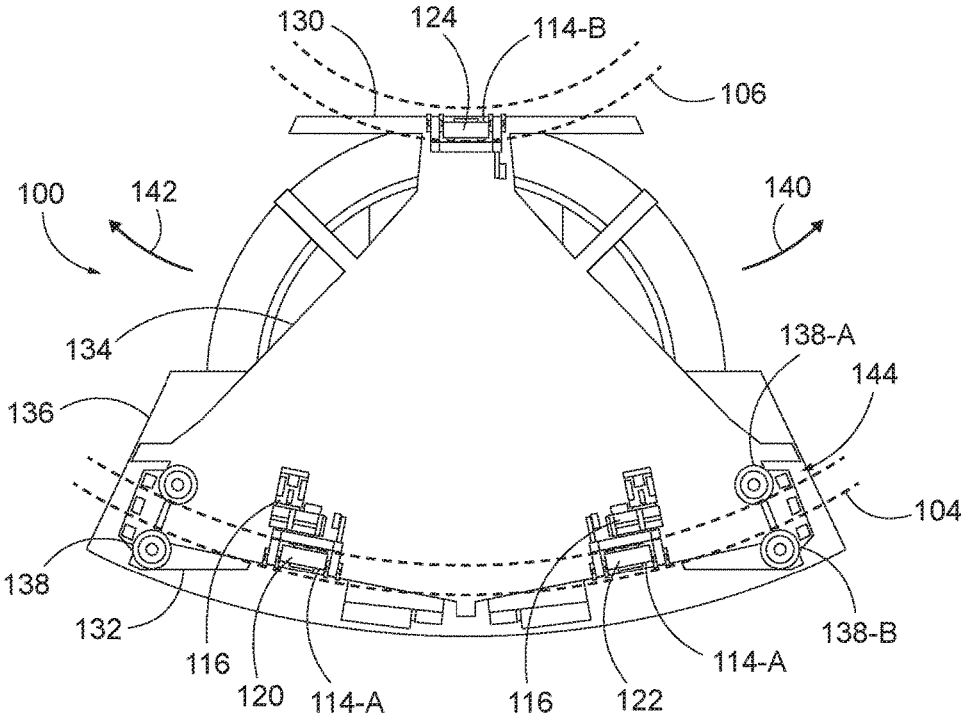
FIG. 3 is a bottom view of one embodiment of one of a plurality of wagons.

Each of the plurality of wagons 110 can comprise a plurality of motion components 114, also referred to herein as motion features 114. These motions components 114 can include one or several outer motion features 114-A that can be coupled, and specifically can be movingly coupled, to the outer rail 104 of the track 102 and one or several inner motion features 114-B that can be coupled, and specifically can be movingly coupled, to the inner rail 106 of the track 102. The motion components 114 can comprise any feature, features, or mechanism that allows the movement of each of the plurality of wagons 110 along the track. In some embodiments, and as seen in FIG. 3, which shows a bottom view of one embodiment of one of the plurality of wagons 110, the motion features 114 can comprise one or several wheels, treads, magnets, skids, or the like. In some embodiments, each of the plurality of wagons 110 can include a first motion component 120, a second motion component 122, and a third motion component 124. As seen in FIG. 3, the first and second motion components 120, 122 comprise the outer motion components 104-A and the third motion component 124 comprises the inner motion component 114-B. In some embodiments, the outer motion features 114-A can comprise a plurality of wheels, and specifically can comprise two wheels, also referred to herein as a pair of outer wheels, and the inner motion feature 114-B can comprise a single wheel.

In some embodiments, each of the plurality of wagons 110 has a plurality of motion components 114 connecting the wagon 110 to the track 102 and/or allowing the wagon 110 to ride on the track 102. In some embodiments, these motion components 114 can comprise three motion components 114, and specifically can comprise three wheels. In some embodiments, the motion components 114 of each wagon 110 can be configured such that each wagon 110 is stable on the track 102. As used herein, a wagon 110 is stable on the track 102 when the motion of the wagon 110 around the track 102 does not interfere with the ability of the simulation system to create a simulation. Such interference could include, for example, bumps or shifts that do not correspond with an event in the simulation and that are noticeably experienced by a passenger of the simulation system.

In some embodiments, some or all of the plurality of wagons 110 can include one or several driven motion components 114, which driven motion components 114 can cause the plurality of wagons 110 to move around the track 102. In one embodiment, each of the plurality of wagons includes at least one driven motion component 114 that can be coupled to a motor and that can propel at least the one of the plurality of wagons to which it is coupled around the track 102. In some embodiments, each of the plurality of wagons 110 can include a plurality of motors 116 each of which motors 116 can be coupled to one of the motion components of that one of the plurality of wagons 110. In one particular embodiment, each of the plurality of wagons comprises two outer motion components 114-A, which two outer motion components 114-A are each powered by a motor 116, and each of which two outer motion components 114-A is controlled independently and/or is driven independently of the other of the two outer motion components 114-A.

In some embodiments, each of the plurality of wagons 110 can be independently driven or propelled and/or redundantly driven such that that segmented turntable 112 can continue moving around the track 102 when one or several driven motion components 114 and specifically when one or several motors 116 of the segmented turntable 112 and/or of one or several of the plurality of wagons 110 fail. In some embodiments, for example, in the event that one or several of the motors 116 fails, additional power can be provided to the remaining driven motion components 114 and/or remaining functioning motors 116. In some embodiments, this increase in power provided to the remaining one or several driven motion components 114 and/or motors 116 can trigger an alarm which can identify the one or several non-operational and/or inadequately operational driven motion components 114 and/or motors 116.

The redundancy of driving of the wagons 110 of the segmented turntable 112 can be further enhanced via the coupling of the plurality of wagons 110 in the segmented turntable 112. In some embodiments, the plurality of wagons 110 are connected to each other via a plurality of towbars 118, each of which can be, in some embodiments, a constant length towbar, which constant length towbar can have a constant length. In some embodiments, each of the towbars 118 can comprise a first ball joint at a first end of the towbar 118 and a second ball joint at a second end of the towbar 118. In some embodiments, the first ball joint can connect the towbar 118 to a first one of a pair of the plurality of wagons 110 and the second ball joint can connect the towbar 118 to a second one of the pair of the plurality of wagons 110. In some embodiments, the towbars 118 can be designed to allow pulling of one or several of the plurality of wagons 110 that are not driven by their own driven motion components 114.

As seen in FIG. 3, each of the wagons 110 can include an inner portion 130 having a first length and an outer portion 132 having a second length. In some embodiments, the inner and outer portions 130, 132 can be connected to each other via, for example, one or several connecting portions 134. The portions 130, 132, 134 can comprise any size, shape, and/or material. In some embodiments, some or all of the portions 130, 132, 134 can comprise one or several beams which can include, for example, one or several structural beams that can be, for example, made from steel. As depicted in FIG. 3, in some embodiments, the second length of the outer portion 132 can be greater than the first length of the inner portion 130.

The wagons 110 can include a platform 136, also referred to herein as a bed 136. The platform 136 can be connected to some or all of the connecting portions 134 and can extend from the inner portion 130 to the outer portion 132. The platform 136 can comprise a variety of shapes and sizes and can be made from a variety of materials. In some embodiments, a simulation theater 160 can be coupled to the platform 136 and/or can be mounted on the platform 136.

In some embodiments, the wagons 110 can further include one or several guide-wheels 138. The guide-wheels 138 can, in some embodiments, maintain the coupling of the motion components 120, 122, 124 with the track 102. In some embodiments, the guide-wheels 138 can maintain the coupling of the motion components 120, 122, 124 with the track 102 and direct the motion of each of the wagons 110, and thus the segmented turntable 112, in one of two motion directions indicated by arrows 140, 142. In the embodiment depicted in FIG. 3, the guide-wheels 138 are arranged in pairs 144, each of which pairs engages with opposing portions of the track 102 and specifically with the outer rail 104 of the track 102 to maintain the coupling of the motion components 120, 122, 124 with the track 102. Each pair 144 can include an inner guide-wheel 138-A that can engage an inner portion of the outer rail 104 of the track 102 and an outer guide-wheel 138-B that can engage an outer portion of the outer rail 104 of the track 102.

IV. Wagon and Simulation Theater

Figure 4:
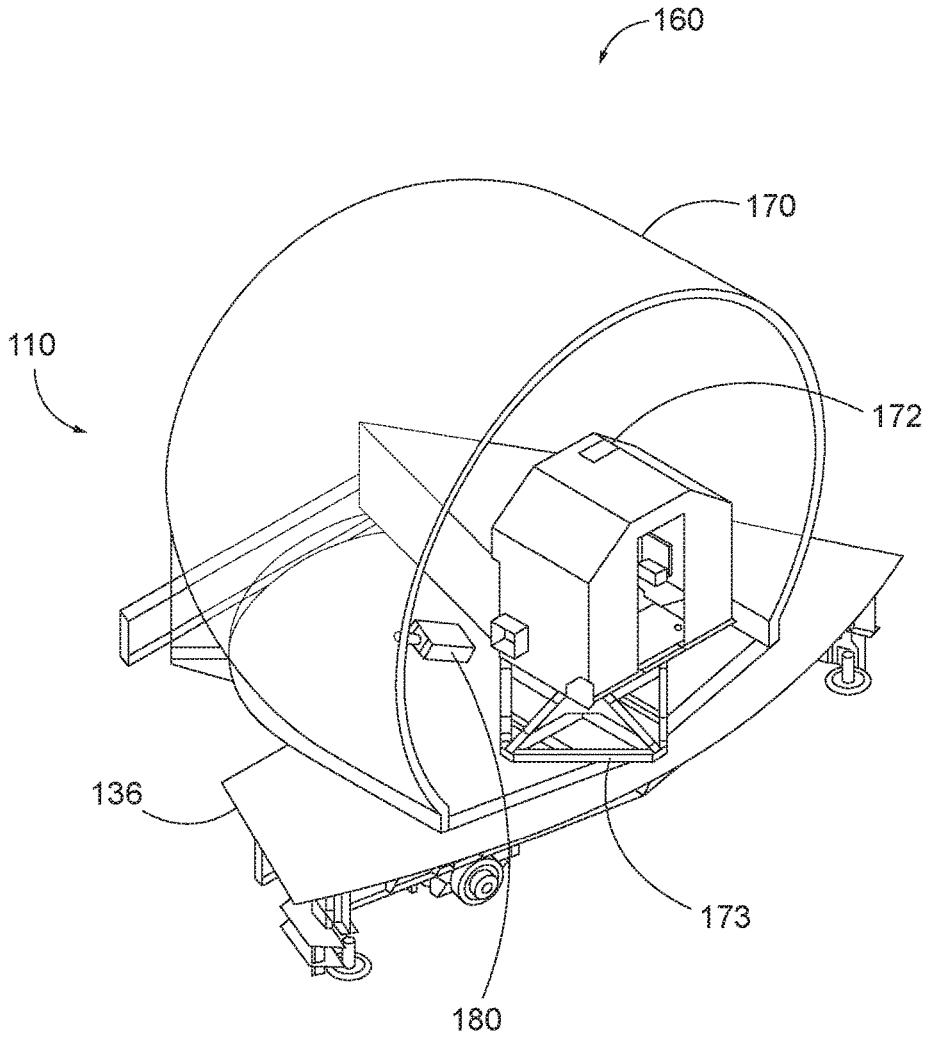
FIG. 4 is a schematic depiction of a perspective view of one embodiment of a wagon including the simulation theater.

FIG. 4 is a schematic depiction of a perspective view of one embodiment of a wagon 110 including the simulation theater 160. As seen in FIG. 4, the simulation theater 160 can be mounted on top of the platform 136 of one of the wagons 110. The simulation theater 160 can include a screen 170 that can extend around all or portions of a seating area 172. The seating area 172 can comprise any desired size and/or shape and can include any desired number of seats. In some embodiments, the seating area 172 can be sized and/or shaped to correspond to vehicle in which passengers travel in the amusement ride. Specifically, in some embodiments, the seating area 172 can be sized and/or shaped to have the look and/or feel of a vehicle, of a portion of the vehicle, of a cockpit, and/or a control room.

The seating area 172 can be coupled to one of the wagons 110 and specifically to the platform 136 of one of the wagons 110. In some embodiments, the seating area 172 can be coupled to the one of the wagons 110 and specifically to the platform 136 via a motion base 173. In some embodiments, the motion base 173 can move the seating area 172 to simulate one or several: motions; accelerations; or the like. In some embodiments, the motion base 173 can have one or several degrees of freedom. In some embodiments, for example, the motion base 173 can have at least two degrees of freedom, at least three degrees of freedom, at least four degrees of freedom, at least five degrees of freedom, at least six degrees of freedom, at least seven degrees of freedom, at least eight degrees of freedom, at least nine degrees of freedom, at least ten degrees of freedom, and/or any other of intermediate number of degrees of freedom. In some embodiments, the motion base 173 can comprise a Stewart platform.

The motion base 173 can comprise one or several passive components which can include, for example, one or several: linkages, couplings, joints, and/or rigid members, and/or one or several active components which can include, for example, one or several: actuators, motors, pistons, springs, pneumatic and/or hydraulic systems and/or components, and/or drives that can be controlled to move the motion base 173 in a desired and/or predetermined manner. In some embodiments, the motion base 173 can comprise a Stewart platform that can comprise at least six degrees of freedom, at least seven degrees of freedom, at least eight degrees of freedom, at least nine degrees of freedom, at least ten degrees of freedom, and/or any other of intermediate number of degrees of freedom. In some embodiments, the motion base 173 can comprise a Stewart platform comprising actuators configured to move the motion base 173 in a desired manner. In some embodiments, the motion base 173 can comprise a Stewart platform comprising at least four actuators, at least five actuators, at least six actuators, at least sever actuators, at least eight actuators, at least nine actuators, at least ten actuators, and/or any other or intermediate number of actuators.

Figure 5:
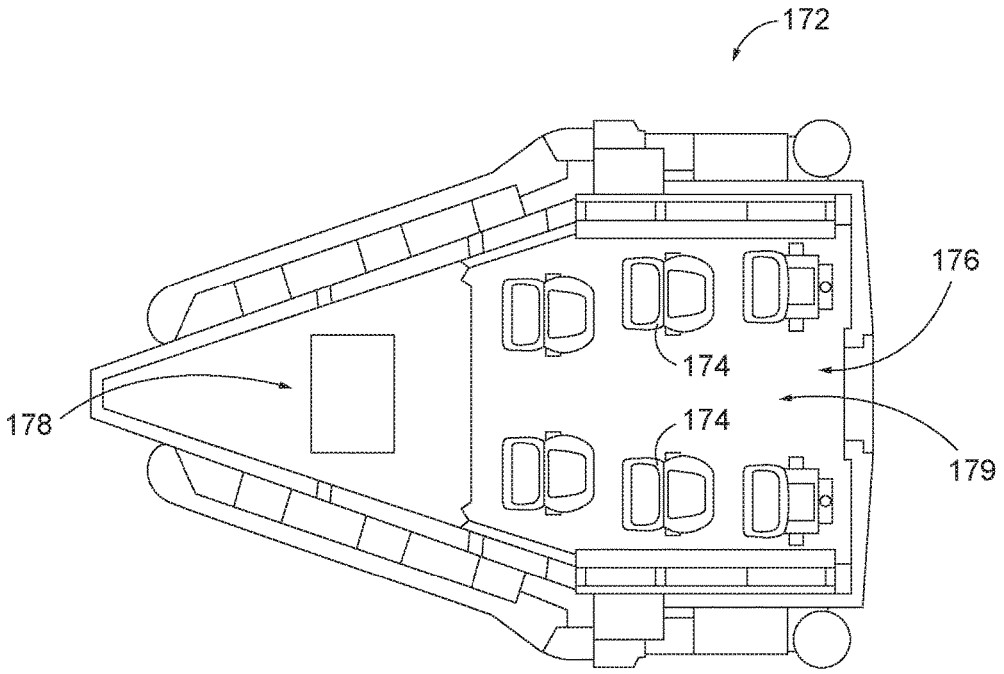
FIG. 5 is a top view of one embodiment of a seating area.

One embodiment of the seating area 172 is shown in FIG. 5. In some embodiments, the seating area 172 can be configured to resemble a portion of a vehicle such as, for example, a cockpit, a command room, a control room, a wheelhouse, a bridge, and/or a passenger area. As seen, the seating area 172 can comprise a plurality of seats 174 arranged to allow a passenger to view out of the seating area 172 and to view all or portions of the screen 170. In some embodiments, the seats 174 in the seating area can comprise one or several passenger restraints such as harnesses, seatbelts, lap-bars, or the like. In some embodiments, the seats 174 in the seating area 172 can be arranged such that seats 174 in a rear portion 176 of the seating area 172 are elevated relative to seats 174 in a front portion 178 of the seating area 172. In some embodiments, the seats 174 in the seating area 172 can be arranged to facilitate ingress of passengers into the seating area 172 and/or egress of the passengers from the seating area 172, in some embodiments, this can include arranging the seats 174 to create an aisle 179 and/or passage 179 between some or all of the seats 174.

In some embodiments, the seating area 172 can have a first orientation. In some embodiments, this first orientation of the seating area 172 can point some or all of the plurality of the seats 174 in viewing direction indicated by arrow 178. In some embodiments, the viewing direction can be orthogonal to one or both of the one of two motion directions indicated by arrows 140, 142 in FIG. 3.

Referring again to FIG. 4, the simulation theater 170 can, in some embodiments, include one or several projectors 180. The one or several projectors 180 can be arranged and/or configured to illuminate all or portions of the screen 170, and specifically to illuminate at least a portion of the screen 170. In some embodiments, each of the simulation theater 160, the screen 170, and the projector 180 are coupled to at least one of the plurality of turntable wagons 110. These one or several projectors 180 can include one or several speakers, tweeters, subwoofers, sound systems, and/or amplifiers. In some embodiments, these one or several projectors 180 can be controlled by one or several processors and/or servers to display content to one or several passengers. In some embodiments, the same one or several processors and/or servers can also control the motion base 173 and/or one or several of the wagons 110 and specifically the one or several driven motion components 114 of the one or several wagons 110.

V. Computer System

Figure 6:
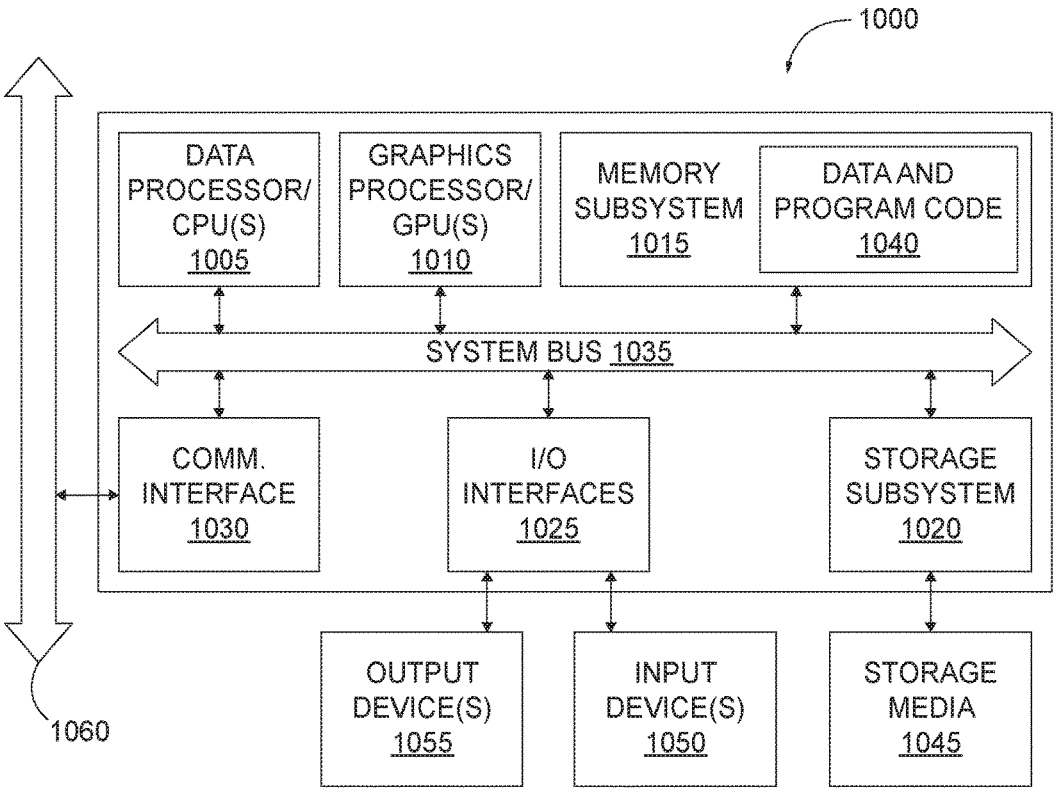
FIG. 6 is a block diagram of a computer system or information processing device that may incorporate an embodiment, be incorporated into an embodiment, or be used to practice any of the innovations, embodiments, and/or examples found within this disclosure.

FIG. 6 shows a block diagram of computer system 1000 that is an exemplary embodiment of the processor 102 and can be used to implement methods and processes disclosed herein. FIG. 6 is merely illustrative. Computer system 1000 may include familiar computer components, such as one or more one or more data processors or central processing units (CPUs) 1005, one or more graphics processors or graphical processing units (GPUs) 1010, memory subsystem 1015, storage subsystem 1020, one or more input/output (I/O) interfaces 1025, communications interface 1030, or the like. Computer system 1000 can include system bus 1035 interconnecting the above components and providing functionality, such connectivity and inter-device communication.

The one or more data processors or central processing units (CPUs) 1005 execute program code to implement the processes described herein. The one or more graphics processor or graphical processing units (GPUs) 1010 execute logic or program code associated with graphics or for providing graphics-specific functionality. Memory subsystem 1015 can store information, e.g., using machine-readable articles, information storage devices, or computer-readable storage media. Storage subsystem 1020 can also store information using machine-readable articles, information storage devices, or computer-readable storage media. Storage subsystem 1020 may store information using storage media 1045 that can be any desired storage media.

The one or more input/output (I/O) interfaces 1025 can perform I/O operations and the one or more output devices 1055 can output information to one or more destinations for computer system 1000. One or more input devices 1050 and/or one or more output devices 1055 may be communicatively coupled to the one or more I/O interfaces 1025. The one or more input devices 1050 can receive information from one or more sources for computer system 1000. The one or more output devices 1055 may allow a user of computer system 1000 to view objects, icons, text, user interface widgets, or other user interface elements.

Communications interface 1030 can perform communications operations, including sending and receiving data. Communications interface 1030 may be coupled to communications network/external bus 1060, such as a computer network, a USB hub, or the like. A computer system can include a plurality of the same components or subsystems, e.g., connected together by communications interface 1030 or by an internal interface.

Computer system 1000 may also include one or more applications (e.g., software components or functions) to be executed by a processor to execute, perform, or otherwise implement techniques disclosed herein. These applications may be embodied as data and program code 1040. Such applications may also be encoded and transmitted using carrier signals adapted for transmission via wired, optical, and/or wireless networks conforming to a variety of protocols, including the Internet.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. An rotating indexed turntable comprising:

a looped track comprising an inner rail and an outer rail;

a plurality of adjacent turntable wagons linked together in a closed chain and movingly coupled to the looped track, wherein each of the turntable wagons are independently propelled along the looped track, each of the plurality of turntable wagons comprising:

an inner portion having a first length;

an outer portion having a second length, wherein the second length is greater than the first length;

a plurality of outer motion features movingly coupled to the outer rail of the looped track; and at least one inner motion feature movingly coupled to the inner rail of the looped track.

2. The rotating indexed turntable of claim 1, wherein the looped track comprises a circular track.

3. The rotating indexed turntable of claim 2, wherein the plurality of outer motion features comprise a plurality of outer wheels.

4. The rotating indexed turntable of claim 2, wherein the plurality of outer motion features comprises a pair of outer wheels, and wherein the inner motion feature comprises a single wheel.

5. The rotating indexed turntable of claim 3, the plurality of turntable wagons further comprising a plurality of motors connected to the plurality of outer wheels.

6. The rotating indexed turntable of claim 5, wherein each of the plurality of outer wheels is independently driven.

7. The rotating indexed turntable of claim 1, wherein each of the plurality of turntable wagons is connected to each of two other turntable wagons via a towbar.

8. The rotating indexed turntable of claim 7, wherein the towbar has a constant length.

9. The rotating indexed turntable of claim 1, further comprising: at least one simulation theater; a screen; and a projector, wherein each of the simulation theater, the screen, and the projector are coupled to at least one of the plurality of turntable wagons.

10. The rotating indexed turntable of claim 9, wherein the at least one simulation theater is coupled to the at least one of the plurality of turntable wagons via a motion base.

11. The rotating indexed turntable of claim 10, wherein the motion base comprises a Stewart platform having eight actuators.

* * * * *